US008745899B2

(12) United States Patent
Schenone

(10) Patent No.: US 8,745,899 B2
(45) Date of Patent: Jun. 10, 2014

(54) ARTICLE OF FOOTWEAR INCLUDING A SIZING SYSTEM

(75) Inventor: Scott Schenone, Pasadena, CA (US)

(73) Assignee: NIKE, Inc., Beaverton, OR (US)

( * ) Notice: Subject to any disclaimer, the term of this patent is extended or adjusted under 35 U.S.C. 154(b) by 1050 days.

(21) Appl. No.: 12/062,669

(22) Filed: Apr. 4, 2008

(65) Prior Publication Data

US 2009/0249649 A1 Oct. 8, 2009

(51) Int. Cl.

| | |
|---|---|
| ***A43B 3/26*** | (2006.01) |
| ***A43B 7/20*** | (2006.01) |
| ***A43B 7/16*** | (2006.01) |
| ***A43B 23/28*** | (2006.01) |

(52) U.S. Cl.

USPC ..... 36/97; 36/89; 36/92; 36/58.5

(58) Field of Classification Search

CPC ..... A43B 3/26; A43B 23/28; A43B 21/32; A43B 23/07

USPC ..... 36/92, 97, 88, 90, 112, 58.5, 71, 105, 36/69

See application file for complete search history.

(56) References Cited

U.S. PATENT DOCUMENTS

| | | | | |
|---|---|---|---|---|
| 902,929 | A | 11/1908 | Telford | |
| 1,176,572 | A | 3/1916 | Lassig | |
| 1,548,172 | A | 8/1925 | Redden | |
| 1,749,084 | A * | 3/1930 | McCarthy | 36/58.5 |
| 1,926,818 | A | 9/1933 | Ratcliff | |
| 1,966,179 | A * | 7/1934 | Lesch | 36/58.5 |
| 2,742,715 | A | 4/1956 | Meltzer | |
| 3,431,658 | A | 3/1969 | Finn | |
| 3,758,964 | A | 9/1973 | Nishimura | |
| 3,810,318 | A | 5/1974 | Epstein | |
| 4,712,319 | A * | 12/1987 | Goria | 36/137 |
| 4,726,126 | A | 2/1988 | Bernhard | |
| 4,783,911 | A * | 11/1988 | Brown | 36/115 |
| 4,817,306 | A | 4/1989 | Bayer | |
| 4,869,001 | A * | 9/1989 | Brown | 36/115 |
| 5,113,526 | A | 5/1992 | Wang et al. | |
| 5,136,726 | A * | 8/1992 | Kellin et al. | 2/244 |
| 5,230,333 | A | 7/1993 | Yates et al. | |
| 5,265,349 | A | 11/1993 | Munschy | |
| 5,430,961 | A | 7/1995 | Faulconer et al. | |
| 5,606,808 | A | 3/1997 | Gilliard et al. | |
| 5,740,618 | A * | 4/1998 | Minden | 36/8.3 |
| D398,146 | S | 9/1998 | Herndon | |
| 5,974,590 | A * | 11/1999 | Stubbs | 2/239 |

(Continued)

FOREIGN PATENT DOCUMENTS

| | | |
|---|---|---|
| EP | 0528130 | 2/1993 |
| FR | 2149963 | 3/1973 |

*Primary Examiner* — Khoa Huynh
*Assistant Examiner* — Timothy K Trieu
(74) *Attorney, Agent, or Firm* — Plumsea Law Group, LLC

(57) ABSTRACT

An article of footwear with a size-adjustable system capable of adjusting the size of the artifice of footwear is provided. The size-adjustable system comprises three sets of removable inserts. The inserts engage the article of footwear in the heel region of the upper to provide both space-filling in the heel region as well as stabilization of the foot. When each set of sizing inserts are disposed within the article of footwear, the size of the foot the article of footwear is capable of receiving is different. By providing a size-adjustable system, the article of footwear is capable of receiving multiple foot sizes, such as that of a growing child.

24 Claims, 11 Drawing Sheets

(56) References Cited

U.S. PATENT DOCUMENTS

| | | | | |
|---|---|---|---|---|
| 6,082,027 | A | 7/2000 | Wagonhurst | |
| 6,101,655 | A * | 8/2000 | Buddle | 12/146 C |
| 6,442,874 | B1 | 9/2002 | Long | |
| 6,442,875 | B1 | 9/2002 | Joubert et al. | |
| 6,584,707 | B1 | 7/2003 | Racine et al. | |
| 6,804,901 | B2 | 10/2004 | Joubert et al. | |
| 6,920,707 | B1 * | 7/2005 | Greene et al. | 36/97 |
| 7,028,417 | B2 | 4/2006 | Tingle | |
| 7,168,188 | B2 | 1/2007 | Auger et al. | |
| 7,293,370 | B2 * | 11/2007 | Kaplan et al. | 36/8.4 |
| 2004/0049951 | A1 * | 3/2004 | Chen | 36/93 |
| 2006/0213087 | A1 * | 9/2006 | Gallegos | 36/97 |
| 2007/0039208 | A1 | 2/2007 | Bove et al. | |
| 2007/0039209 | A1 | 2/2007 | White et al. | |
| 2010/0024248 | A1 | 2/2010 | Baker et al. | |

* cited by examiner

ARTICLE OF FOOTWEAR INCLUDING A SIZING SYSTEM

BACKGROUND OF THE INVENTION

1. Field of the Invention

This invention relates to size-adjustable footwear, and more particularly an article of footwear with a removable insert system configured to alter the size of the article of footwear.

2. Description of Related Art

As children grow, numerous pairs of shoes in increasing sizes are required to accommodate their growing feet. Often, children outgrow shoes before receiving much use from the shoes. Therefore, parents invest a significant amount of money replacing shoes for their growing child. This problem is magnified for certain types of shoes worn for specific occasions or seasons, such as dress shoes or snow boots.

To avoid the cost of replacing shoes on a frequent basis, some parents might purchase shoes in sizes larger than their children's feet to allow the children to grow into them. Other parents may have their children wear a pair of shoes even though the child has outgrown them. Neither of these practices are desirable because the shoes will not likely fit properly, possibly causing podiatric problems.

Typically, most children's feet grow approximately one full shoe size per year, or one-half shoe size every four to six months. Consequently, larger shoes are purchased frequently to accommodate the growing foot size. This frequent shoe purchasing may be financially burdensome for families. Thus, providing a system for allowing multiple foot sizes to fit properly within the footwear would be advantageous to extend the life of footwear by. Additionally, providing footwear that fits properly over many foot sizes may eliminate the potential for the onset of podiatric problems due to improper fit of the footwear.

Several solutions have been proposed to accommodate multiple foot sizes with one article of footwear. Long (U.S. Pat. No. 6,442,874) teaches an article of footwear having an adjustable sizing mechanism disposed within the heel of the upper of the article of footwear. The Long invention provides a solution for accommodating multiple foot sizes. Additionally, Finn (U.S. Pat. No. 3,431,658) teaches a shoe having an expandable bellows disposed within the heel region of the shoe. The expandable bellows taught in the Finn invention provides the ability to adjust the length of the shoe to accommodate multiple foot lengths.

The solutions proposed within the art, while they provide for adjustable sizing of articles of footwear, they do not provide for removal of the adjustable sizing mechanism. This may prove to be disadvantageous when the wearer's foot is large enough to fit within the footwear without any need for an adjustable sizer. As a result, the footwear may become uncomfortable to wear or create irritation points on the heel of the wearer's foot. Furthermore, due to the sizing members within the proposed solutions being a non-removable feature, the footwear may become susceptible to wear during the prolonged use requiring replacement of the footwear.

Therefore, a need exists in the art for an adjustable sizing system for an article of footwear that is removable, allowing low cost replacement of the removable system.

SUMMARY OF THE INVENTION

An article of footwear including a sizing adjustment system is disclosed. In one aspect, the invention provides a sizing adjustment system for modifying the size of an article of footwear comprising a first insert configured to be removably attached to a heel region of the article of footwear, a second removable insert configured to be removably attached to the heel region of the article of footwear, wherein the first insert modifies article of footwear to a first size and the second insert modifies article of footwear to a second size, and wherein the first insert and the second insert are interchangeable.

In another aspect, further comprising a third removable insert configured to modify the article of footwear to a third size, wherein the third insert is interchangeable with the first insert and the second insert.

In another aspect, the first removable insert and the second removable insert are each a set of multiple removable inserts.

In another aspect, the removable inserts are disposed within the heel region of the upper of the article of footwear.

In another aspect, the first set of removable inserts and the second set of removable inserts each comprises a medial removable insert disposed on the medial portion of the heel region and a lateral removable insert disposed on the lateral portion of the heel region.

In another aspect, the first set of removable inserts are larger than the second set of removable inserts.

In another aspect, the third removable insert comprises a set of multiple inserts.

In another aspect, the removable inserts are disposed within the heel region of the article of footwear.

In another aspect, the first set of removable inserts, the second set of removable inserts, and the third set of removable inserts each comprises a medial removable insert disposed on the medial portion of the heel region and a lateral removable insert disposed on the lateral portion of the heel region.

In another aspect, the first set of removable inserts are larger than the second set of removable inserts and the second set of removable inserts are larger than the third set of removable inserts.

In another aspect, the invention provides a method of modifying the size of an article of footwear comprising providing an article of footwear configured to receive removable inserts and a plurality of removable inserts, inserting a first removable insert into the article of footwear to change an original size of the article of footwear to a first altered size, removing the first removable insert, and inserting a second removable insert into the article of footwear to modify the first size to a second size.

In another aspect, the first removable insert is a set of multiple removable inserts.

In another aspect, the article of footwear size is modified to a second size by removing first removable insert and inserting second removable insert.

In another aspect, the first and second removable inserts each comprise a set of multiple removable inserts.

In another aspect, the sizing adjustment system comprises a third removable insert to modify the size of the article of footwear to a third size.

In another aspect, the third removable insert comprises a set of multiple removable inserts.

In another aspect, the invention provides an article of footwear capable of having its size modified, comprising an upper configured to receive a plurality of interchangeable inserts configured to vary a size of the article of footwear.

In another aspect, the upper the upper includes a recess in a sidewall of a heel region, wherein at least a portion of each of the plurality of interchangeable sizing inserts may be press-fitted into the recess.

In another aspect, a plurality of recesses are provided in the heel region.

In another aspect, a first recess is disposed in a medial portion of the heel region of the upper and a second region is disposed in a lateral portion of the heel region of the upper.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

An article of footwear with a removable and replaceable size-adjustable system is disclosed.

Figure 1:
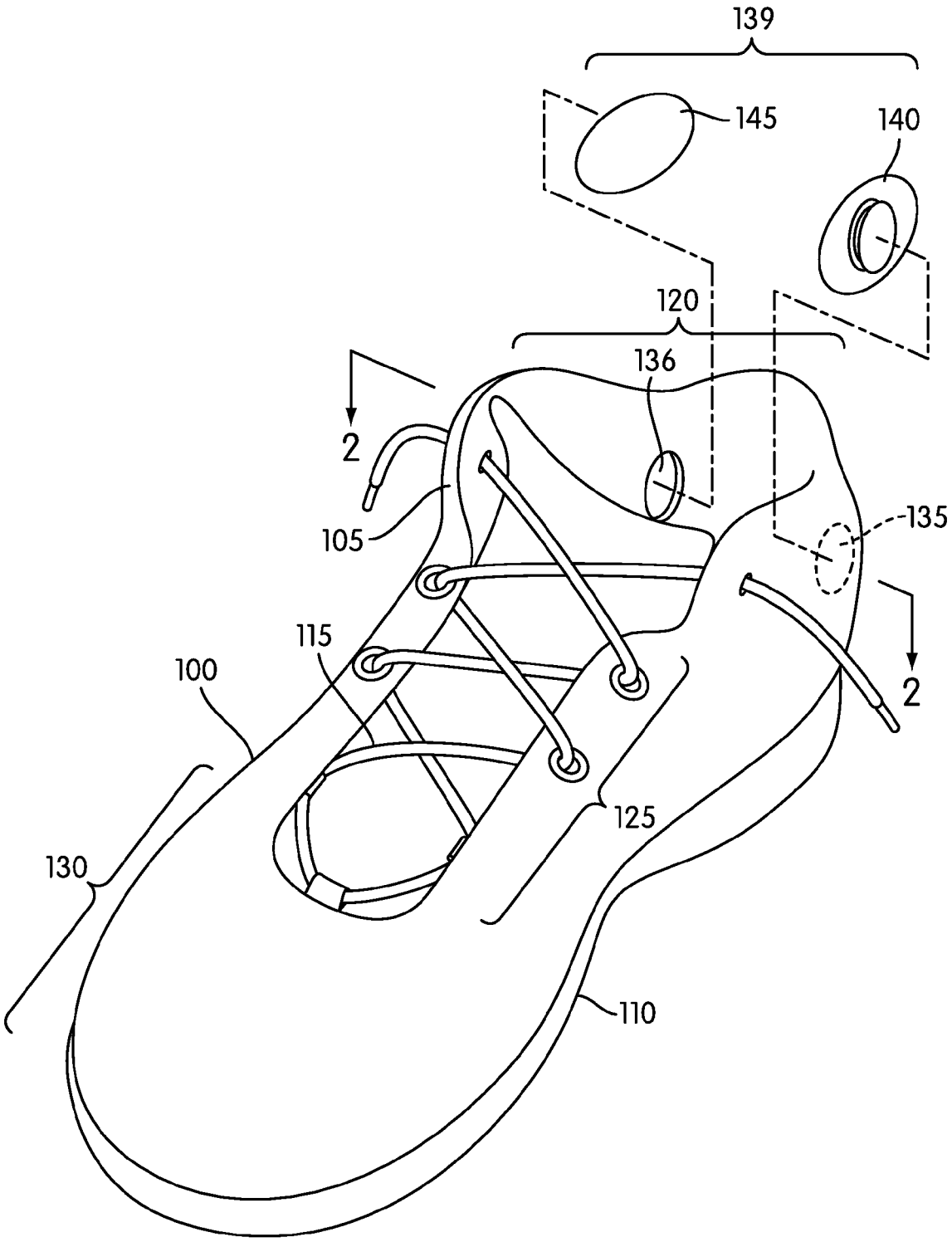
FIG. 1 is an exploded view of an article of footwear having a size-adjustment system.

FIG. 1 illustrates a preferred embodiment of an article of footwear 100. For clarity, the following detailed description discusses a children's shoe, but the present invention could take the form of any article of footwear including, but not limited to, athletic shoes, dress shoes, industrial shoes, cleated shoes, children's shoes, adult shoes, as well as other kinds of articles of footwear.

Article of footwear 100 includes an upper 105 and a sole 110. Upper 105 is preferably disposed on sole 110. Sole 110 may be made from any material known in the art usable as a ground-engaging surface, including but not limited to elastomers, siloxanes, natural rubber, other synthetic rubbers, aluminum, steel, natural leather, synthetic leather, or plastics.

Upper 105 is preferably sized and dimensioned to receive a wearer's foot. Upper 105 generally includes a heel region 120, a middle region 125, and a toe region 130. Generally, upper 105 may be made from any material known in the art used for an upper, including but not limited to natural or synthetic leather, natural or synthetic rubber, natural and synthetic materials such as canvas, nylon, or combinations of these materials.

In some embodiments, upper 105 may include a footwear fastening system 115 disposed in middle region 125 of upper 105. Preferably, footwear fastening system 115 may be used to tighten upper 105 to a wearer's foot. Footwear fastening system 115 may be any type of fastening system known in the art. Examples of footwear fastening systems include, but are not limited to, Velcro®, buckles, and zippers. In a preferred embodiment, footwear fastening system 115 includes laces.

Upper 105 is configured to accommodate a sizing system 139 in heel region 120 to manipulate the size of article of footwear 100. Sizing system 139 includes one or more connections sized and dimensioned to receive any one of a plurality of interchangeable sizing inserts capable of varying the size of article of footwear 100. While any number of connections may be provided in heel region 120, in one embodiment, two connectors are included: a medial connector 135 and a lateral connector 136. In a preferred embodiment, medial connector 135 and lateral connector 136 are symmetric about the long axis of article of footwear 100. By positioning medial connector 135 and lateral connector 136 symmetrically on either side of the foot, sizing system 139 provides equal spacing from both the medial and lateral aspects of article of footwear 100. Equal spacing allows a wearer's foot to remain centered within article of footwear 100, thereby reducing the potential for podiatric problems to develop in the wearer's foot due to poor stability or support.

The number of connectors provided corresponds to the number of sizing inserts used to achieve a single size variation of article of footwear 100. Thus, in the embodiment shown in the figures, two sizing inserts are provided for each size variation: a medial insert and a lateral insert. The figures show a system utilizing three pairs of inserts so that each article of footwear can assume three distinct sizes by replacing one pair of inserts with another pair.

Figure 2:
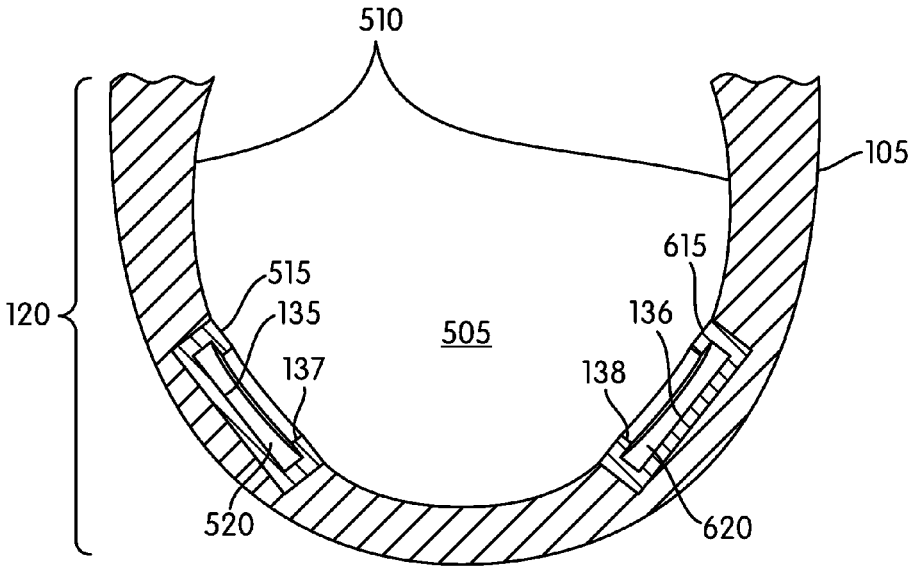
FIG. 2 is a top, cross-sectional view taken along line 2-2 of FIG. 1.

While connectors 135 and 136 may be any type of attachment point or mechanism known in the art capable of receiving or holding in position a sizing insert, connectors 135 and 136 are preferably recesses formed within the sidewalls of upper 105 in heel region 120. Connectors 135 and 136 are preferably sized and dimensioned so that any sizing inserts may be press-fitted or interference-fitted into connectors 135 and 136. Connectors 135 and 136 preferably are disposed completely within upper 105 such that connectors 135 and 136 do not protrude into article of footwear 100. For example, as shown in FIG. 2, in some embodiments, medial connector 135 may have an inward-facing surface 515, facing toward an interior void 505 of footwear 100. Inward-facing surface 515 may be substantially flush with an inward-facing surface 510 of upper 105. Similarly, in some embodiments, lateral connector 136 may have an inward-facing surface 615, which may be substantially flush with inward-facing surface 510 of upper 105. In some embodiments, connectors 135 and 136 may be mechanical fasteners, such as a hook and loop system, snaps, or a button fastening system.

In the embodiment shown in the figures, connectors 135 and 136 generally define circular cavities formed within heel region 120 of upper 105. For example, medial connector 135 may define a first recess (or cavity) 520. Similarly, lateral connector 136 may define a second recess (or cavity) 620. In one embodiment, medial connector 135 is configured with a medial interference lip 137. Additionally, lateral connector 136 is preferably configured with a lateral interference lip 138. The cavity and interference lip structure preferably mates with a corresponding engagement system on removable sizing inserts 140 and 145. Preferably, connectors 135 and 136 are made of a durable material that does not deform over time or irritate the wearer's heel. Connectors 135 and 136 may be made of various materials such as, but not limited to metal, plastic, or rubber.

Figure 3:
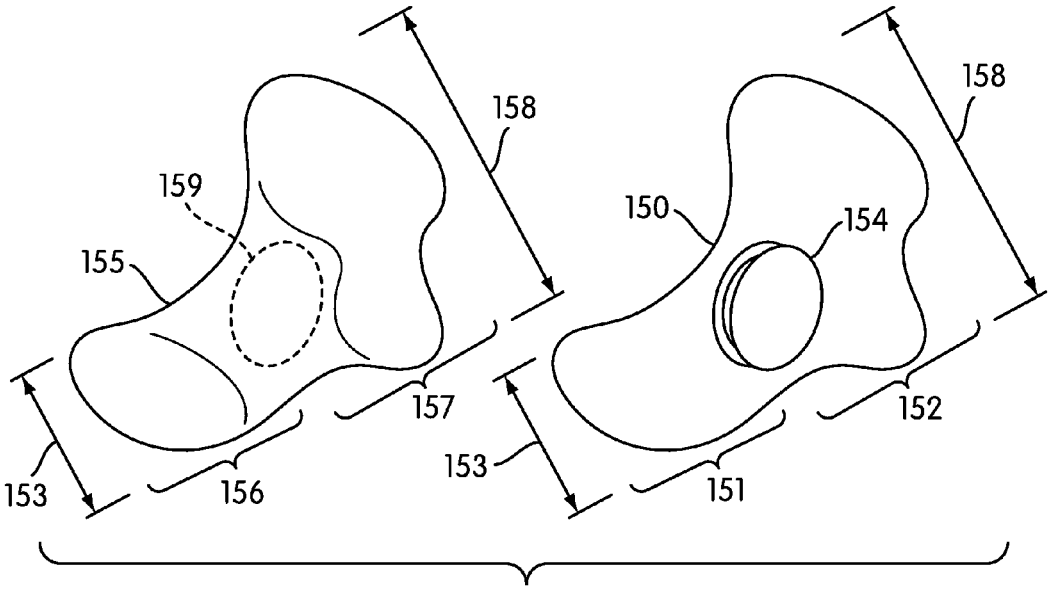
FIG. 3 is a perspective view of a set of removable spacers.
Figure 4:
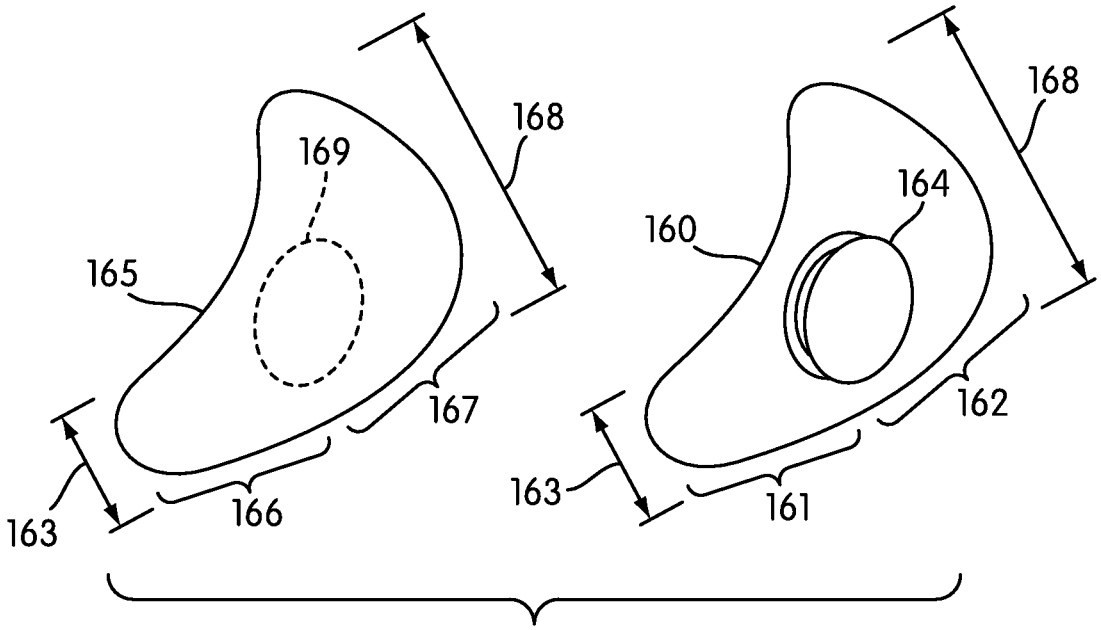
FIG. 4 is a perspective view of a set of removable spacers.
Figure 5:
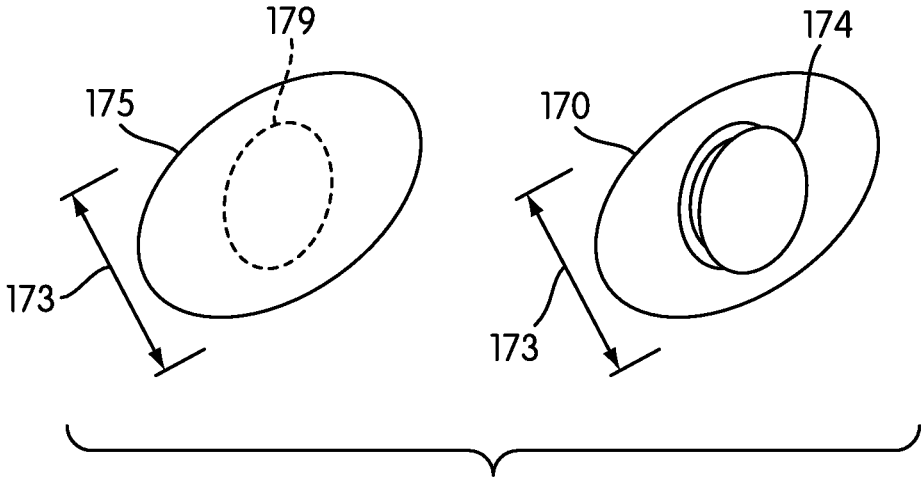
FIG. 5 is a perspective view of a set of removable spacers.

Referring to FIGS. 3-5, an embodiment of sizing system 139 is shown and described as including three sets of interchangeable sizing inserts. Each set of inserts preferably includes a medial and a lateral insert. In this embodiment, the inserts are configured with engagements that are pressed into the recesses of connectors 135 and 136 on upper 105. In this embodiment, the engagements are molded spheroid surfaces designed to match the cavity shape of connectors 135 and 136. The spheroid surfaces are sized and dimensioned so as to engage with interference lips 137 and 138, such as by press-fitting. Interference lips 137 and 138 grip the spheroid surfaces of the inserts to retain the inserts during use of article of footwear 100 while still allowing for removal of the inserts for replacement with a different set of inserts.

Generally, the inserts contact the heel of a wearer's foot. The insert designs are preferably shaped to conform to the anatomical shape of the calcaneus bone, which makes up the heel of a foot. For the large and medium insert sets, the inserts are preferably configured with an anterior surface contacting region and a posterior surface contacting region to provide additional stabilization to the wearer's foot.

The different regions accommodate different amounts of contact area between of the bone structures of the heel and the upper of the article of footwear. The posterior aspect of the heel generally contacts more of the upper than the anterior-medial or anterior-lateral aspects of the heel. As such, the anterior surface contacting region preferably has a smaller height than the posterior surface contacting region. For the small inserts, the wearer's foot generally fits the article of footwear sufficiently. The small inserts preferably provide a small amount of space filling and coverage over connectors 135 and 136.

Referring to FIG. 3, a preferred embodiment of large inserts is shown. Preferably, large medial insert 150 is configured with medial upper attachment 154 to engage medial attachment 135 of upper 105. Additionally, large lateral insert 155 is configured with lateral upper attachment 159 to engage lateral attachment 136 of upper 105.

In this embodiment, large medial insert 150 and large lateral insert 155 are mirror images. In other embodiments, the corresponding inserts may not be symmetric or mirror images of each other. Large medial insert 150 preferably includes an anterior spacing region 151 having first anterior height 153 and a posterior spacing region 152 having first posterior height 158. Additionally, large lateral insert 155 preferably includes anterior spacing region 156 having a first anterior height 153 and posterior spacing region 157 having first posterior height 158. Preferably, first anterior height 153 is less than first posterior height 158 such that inserts 150 and 155 may provide an optimal fit of a wearer's foot. Using this configuration, inserts 150 and 155 may be removably attached to upper 105 for modifying the size of article of footwear 100.

Referring to FIG. 4, a preferred embodiment of a medium set of inserts is shown. Preferably, medium medial insert 160 is configured with medial upper attachment 164 to engage medial attachment 135 of upper 105. Additionally, medium lateral insert 165 is configured with lateral upper attachment 169 to engage lateral attachment 136 of upper 105.

In this embodiment, medium medial insert 160 and medium lateral insert 165 are mirror images. While this is preferred for the present disclosed embodiment, it can be imagined that the corresponding removable spacers may or may not be symmetric in any way. Medium medial insert 160 preferably includes anterior spacing region 161 having second anterior height 163 and posterior spacing region 162 having second posterior height 168. Additionally, medium lateral insert 165 preferably includes anterior spacing region 166 having second anterior height 163 and posterior spacing region 167 having second posterior height 168. Preferably, second anterior height 163 is less than first anterior height 153 and second posterior height 168 is less than first posterior height 158 to provide a smaller insert. Additionally, second anterior height 163 is preferably smaller than second posterior height 168 such that inserts 160 and 165 may better conform to the contours of a wearer's foot. Using this configuration, inserts may be removably attached to upper 105 for modifying the size of article of footwear 100.

Referring to FIG. 5, a preferred embodiment of a small set of inserts is shown. Preferably, small medial insert 170 is configured with medial upper attachment 174 to engage medial attachment 135 of upper 105. Additionally, small insert 175 is configured with lateral upper attachment 179 to engage lateral attachment 136 of upper 105.

In this embodiment, small medial insert 170 and small lateral insert 175 are mirror images. In other embodiments, however, the corresponding inserts may or may not be symmetric. Small medial insert 170 and small lateral insert 175 are preferably oval in shape and include height 173 corresponding to the short axis of the oval shape. Preferably, height 173 is less than second posterior height 168. Additionally, height 173 is configured such that inserts 170 and 175 may provide an optimal fit of a wearer's foot. Using this configuration, inserts may be removably attached to upper 105 for modifying the size of article of footwear 100.

The inserts are preferably manufactured of a material soft enough to cushion the heel while providing support to stabilize the wearer's foot. Size-adjustable spacers 150, 155, 160, 165, 170, 175 may be constructed of durable and supportive materials, including but not limited to elastomers, siloxanes, natural rubber, other synthetic rubbers, natural or synthetic leather, plastics, or any material known in the art capable of supporting and cushioning the heel.

Figure 6:
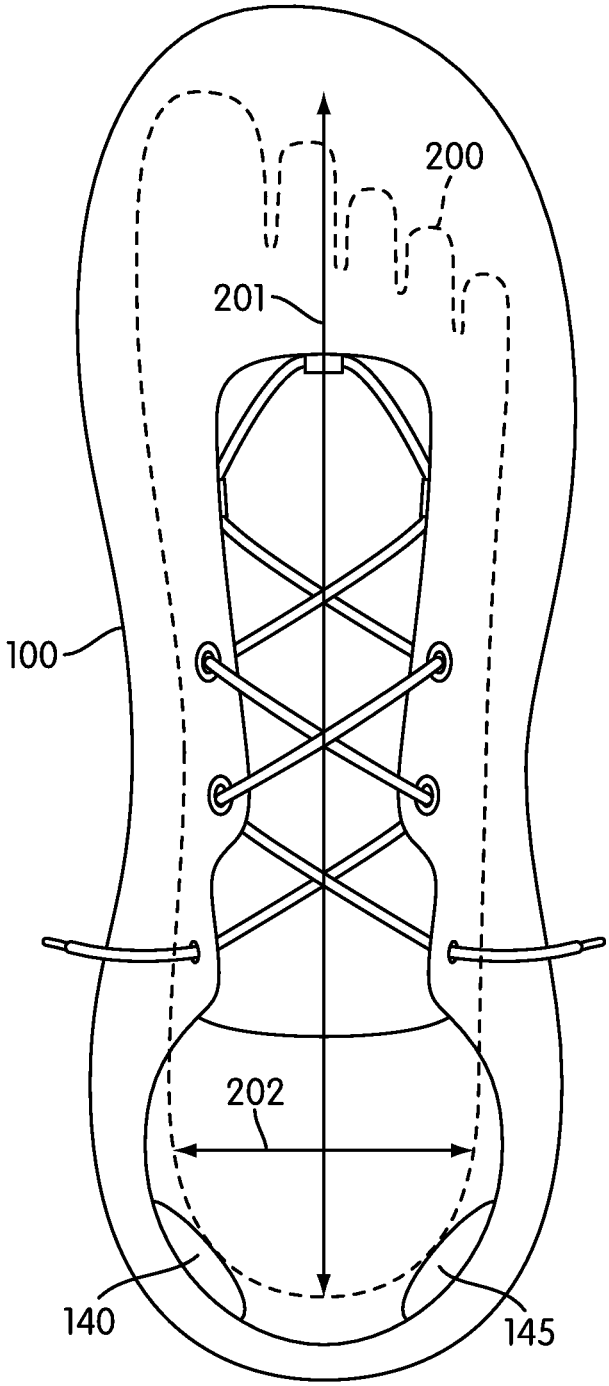
FIG. 6 is a top view of an article of footwear having a removable spacer system.

The system disclosed enables modification of the effective dimensions of a foot that can be received within article of footwear 100. The effective dimensions of article of footwear 100, as depicted in FIG. 6, are herein defined as length 201 of foot 200 and heel girth 202 of foot 200 received within article of footwear 100. By inserting a pair of removable inserts, it is possible to alter length 201 and heel girth 202 of foot 200 that article of footwear 100 can accommodate. This configuration allows the use of article of footwear 100 with multiple foot sizes, such as that of a growing child over time.

Figure 7:
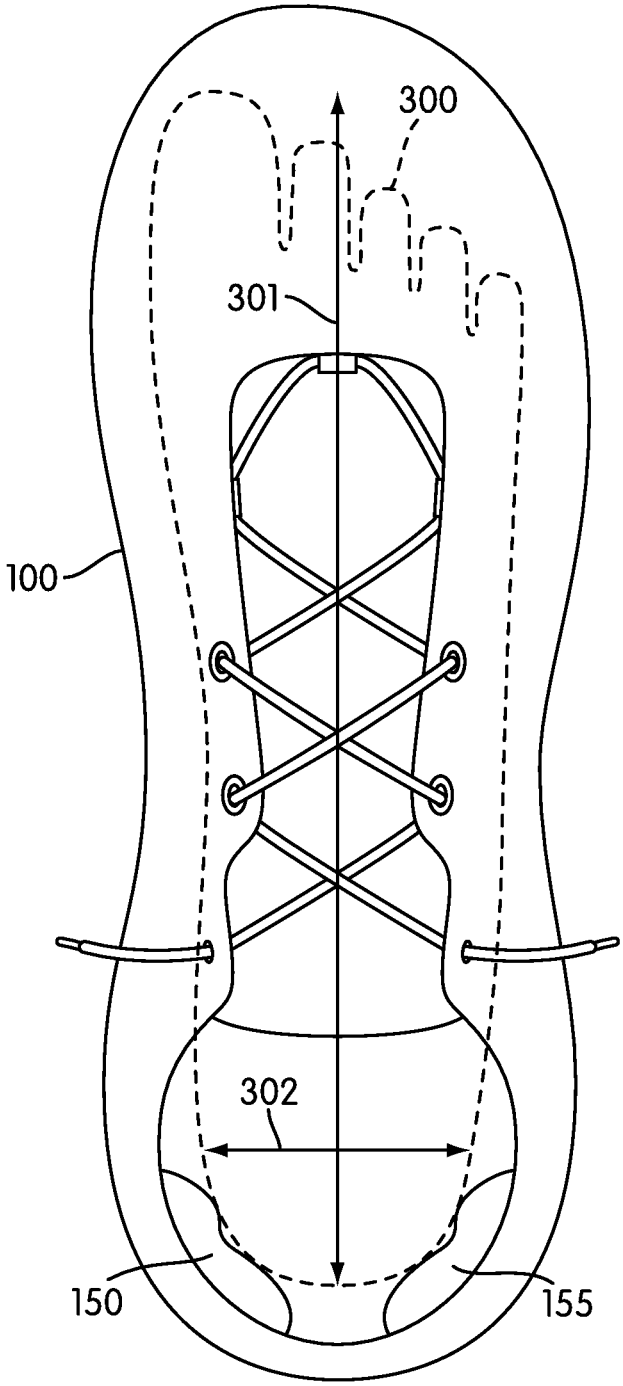
FIG. 7 is a top view of an article of footwear having a set of large-sized removable spacers disposed within.
Figure 8:
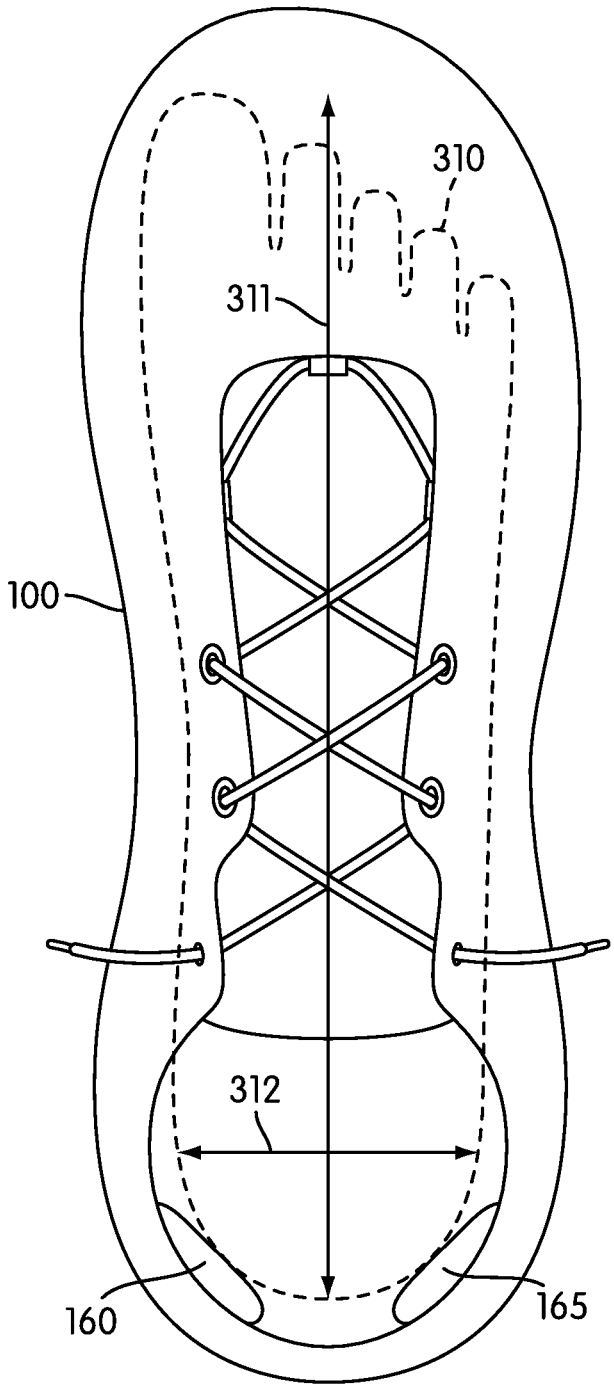
FIG. 8 is a top view of an article of footwear having a set of medium-sized removable spacers disposed within.
Figure 9:
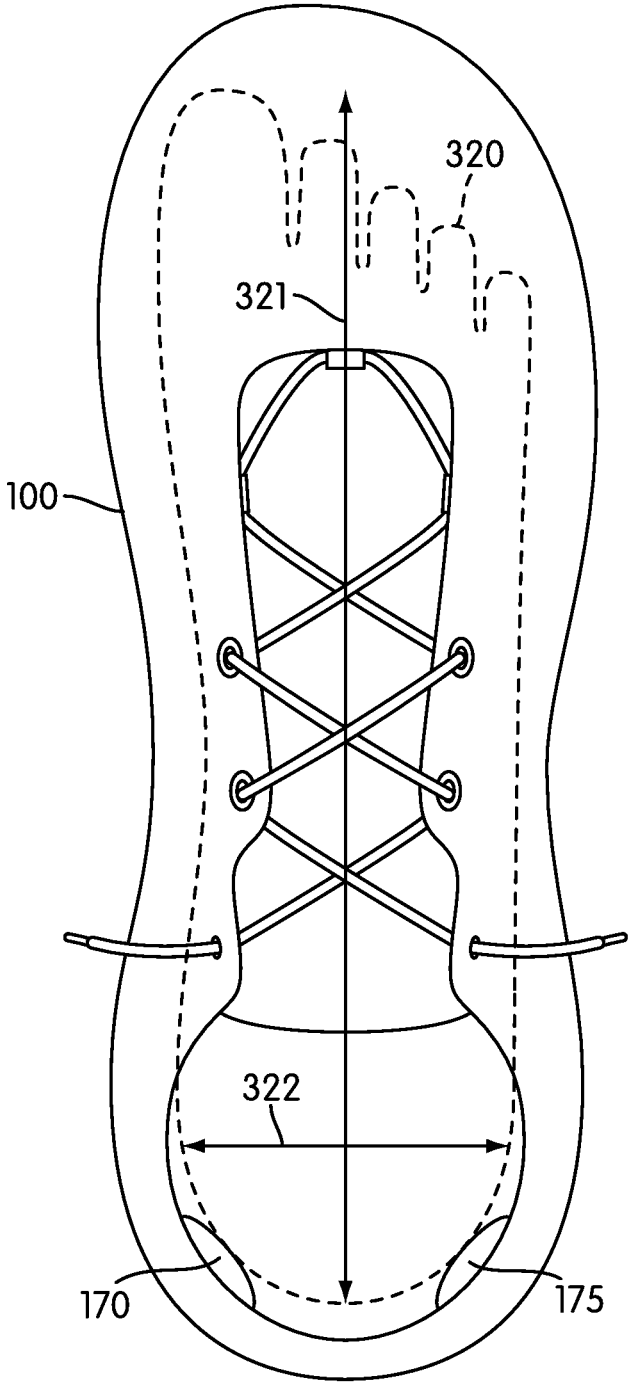
FIG. 9 is a top view of an article of footwear having a set of small-sized removable spacers disposed within.

The use of the size-adjustable system disclosed herein is better illustrated in FIGS. 7-9. Article of footwear 100 has a size, a "box" size, for example a child's size 4. The three insert sets: large inserts 150 and 155, medium inserts 160 and 165, and small inserts 170 and 175, are provided with article of footwear 100 at the point of sale to yield three effective shoe sizes. For example, each pair of inserts may adjust the size of article of footwear 100 by one-half size. Therefore, in one embodiment where article of footwear 100 is designed as a child's size 4, large inserts 150 and 155 decrease the effective size of article of footwear 100 to 3, by occupying a relatively large volume of the interior of article of footwear 100. Medium inserts 160 and 165 decrease the effective size of article of footwear 100 to 3.5, while small inserts 170 and 175 allow article of footwear 100 to be worn at its true size, 4.

Initially, article of footwear 100 is sized to the wearer's feet to be used with large inserts 150 and 155. As the wearer grows, the insert sets may be removably exchanged with a smaller insert set to accommodate the larger foot of the wearer.

As seen in FIG. 7, a first foot 300 having a first length 301 and a first heel girth 302 is received within article of footwear 100. First length 301 is preferably shorter than the optimal length for proper anterior-posterior stability provided by article of footwear 100 without the use of removable spacers. Additionally, first heel girth 302 is preferably smaller than the optimal heel girth for proper medial-lateral stability to be provided by article of footwear 100 without the use of removable spacers.

Preferably, large medial insert 150 and large lateral insert 155 are disposed within article of footwear 100. Large medial insert 150 is removably attached to upper 105 at medial connector 135. Additionally, large lateral insert 155 is removably attached to upper 105 at lateral connector 136. As depicted in FIG. 3, large medial insert 150 preferably includes anterior spacing region 151 and posterior spacing region 152. Additionally, large lateral insert 155 preferably includes anterior spacing region 156 and posterior spacing region 157.

Anterior spacer regions 151, 156 are preferably configured such that they provided cushioning and optimal space filling to accommodate first heel girth 302 of first foot 300. Furthermore, posterior spacer regions 152, 157 are preferably configured such that they provide cushioning and optimal space filling to accommodate first length 301 and first heel girth 302 of first foot 300. By conforming to the heel of first foot 300 in such a manner, first foot 300 is provided medial-lateral stability and anterior-posterior stability within article of footwear 100.

As the feet of the wearer of article of footwear 100 outgrow article of footwear 100 with large inserts 150 and 155, a different insert set size may be used, as seen in FIG. 8. Second foot 310 is the result of first foot 300 growing. Second foot 310 having second length 311 and second heel girth 312 is received within article of footwear 100. Second length 311 is larger than first length 301. Furthermore, second heel girth 312 is larger than first heel girth 302. Preferably, medium medial insert 160 and medium lateral insert 165 are disposed within article of footwear 100. Medium medial insert 160 is removably attached to upper 105 at medial connector 135. Additionally, medium lateral insert 165 is removably attached to upper 105 at lateral connector 136. As depicted in FIG. 4, medium medial insert 160 preferably includes anterior spacing region 161 and posterior spacing region 162. Additionally, medium lateral insert 165 preferably includes anterior spacing region 166 and posterior spacing region 167.

Anterior spacer regions 161,166 are preferably configured such that they provided cushioning and optimal space filling to accommodate second heel girth 312 of second foot 310. Furthermore, posterior spacer regions 162, 167 are preferably configured such that they provide cushioning and optimal space filling to accommodate second length 311 and second heel girth 312 of second foot 310. By conforming to the heel of second foot 310 in such a manner, second foot 310 is provided medial-lateral stability and anterior-posterior stability within article of footwear 100.

When the wearer of article of footwear 100 has grown to have a third foot size such that the feet outgrow article of footwear 100 with medium size-adjustable spacers 160 and 165, small size-adjustable spacers 170 and 175 may be used, as seen in FIG. 9. In this embodiment, third foot 320 having third length 321 and third heel girth 322 is received within article of footwear 100. Third length 321 is larger than second length 311. Furthermore, third heel girth 322 is larger than second heel girth 312. Preferably, small medial insert 170 and small lateral insert 175 are disposed within article of footwear 100. Small medial insert 170 is removably attached to upper 105 at medial connector 135. Additionally, small lateral insert 175 is removably attached to upper 105 at lateral connector 136. Small medial insert 170 and small lateral insert 175 are preferably configured such that they provide cushioning and optimal space filling to accommodate third length 321 and third heel girth 322 of third foot 320. By conforming to the heel of third foot 320 in such a manner, third foot 320 is provided medial-lateral stability and anterior-posterior stability within article of footwear 100.

Figure 10:
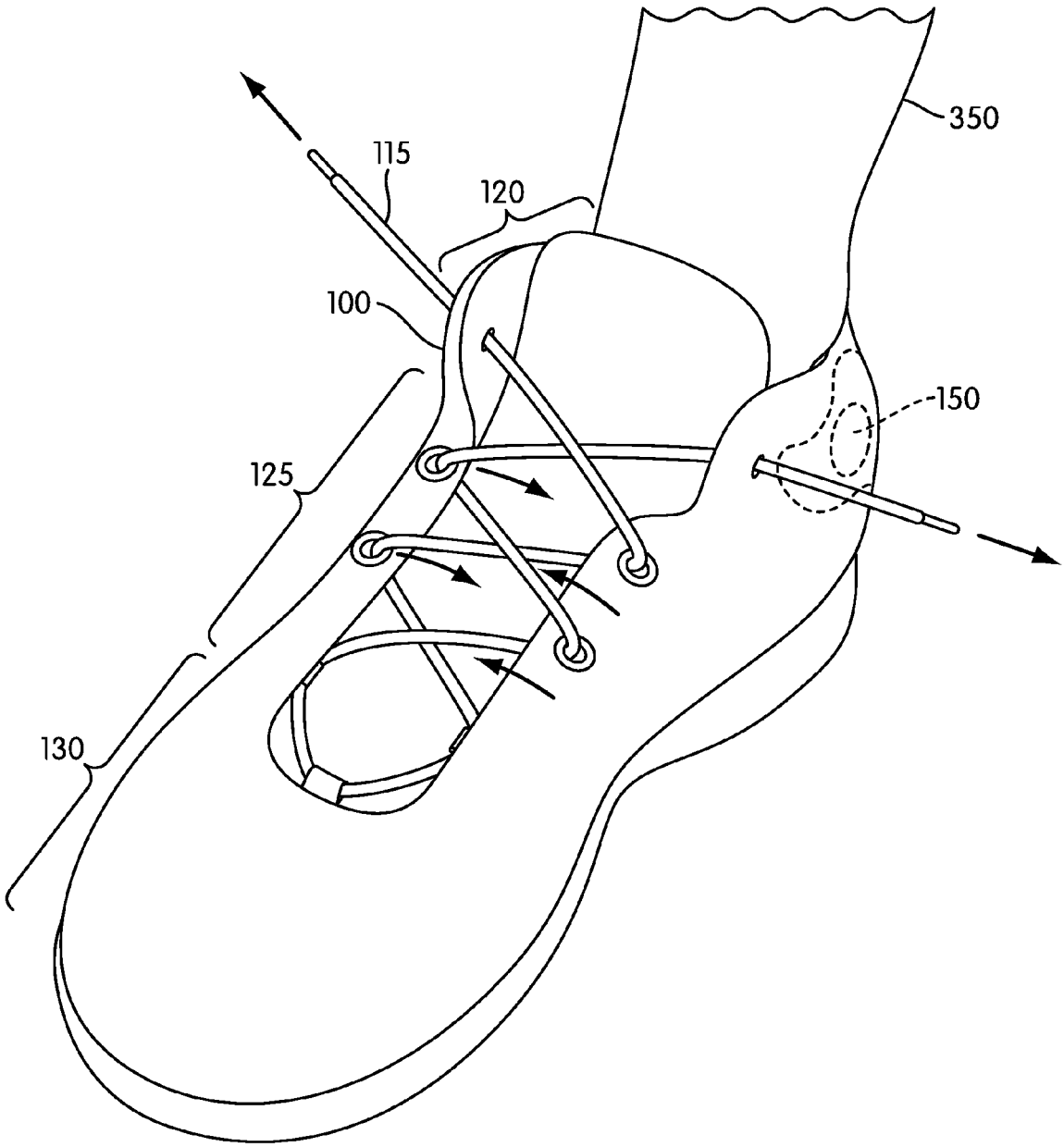
FIG. 10 is a perspective view of an article of footwear having a removable spacer system.

The aforementioned article of footwear and removable spacer system described three discrete foot sizes that would fit within one article of footwear. The removable spacer system may provide the appropriate anterior-posterior length adjustment as well as the heel girth adjustment for the multiple sizes of feet. In addition, the footwear fastening system may provide the appropriate adjustment of the anterior foot width, as depicted in FIG. 10. Article of footwear 100 is provided with foot 350 disposed within upper 105. Footwear fastening system 115 is disposed within middle portion 125 of upper 105. Preferably, footwear fastening system 115 provides the ability to cinch middle portion 125 of upper 105 to a wide range of widths of anterior portion of foot 350. Using this configuration, multiple foot sizes may be accommodated with complete stability throughout the entire article of footwear.

Referring to FIGS. 11-16, another embodiment of sizing system 139 is shown. This embodiment also includes three sets of sizing inserts: a large set shown in FIGS. 11 and 14, a medium set shown in FIGS. 12 and 15, and a small set shown in FIGS. 13 and 16. In this embodiment, two inserts are provided in each set, a medial insert and a lateral insert, where the medial insert and the lateral insert have different geometrical shapes. In other words, the medial insert and the lateral insert are not symmetrical. These different shapes in a single set of inserts may be provided to conform to the geometry of the foot and to stabilize the foot in the article of footwear, such as by shifting the heel of the foot medially or laterally.

Figure 11:
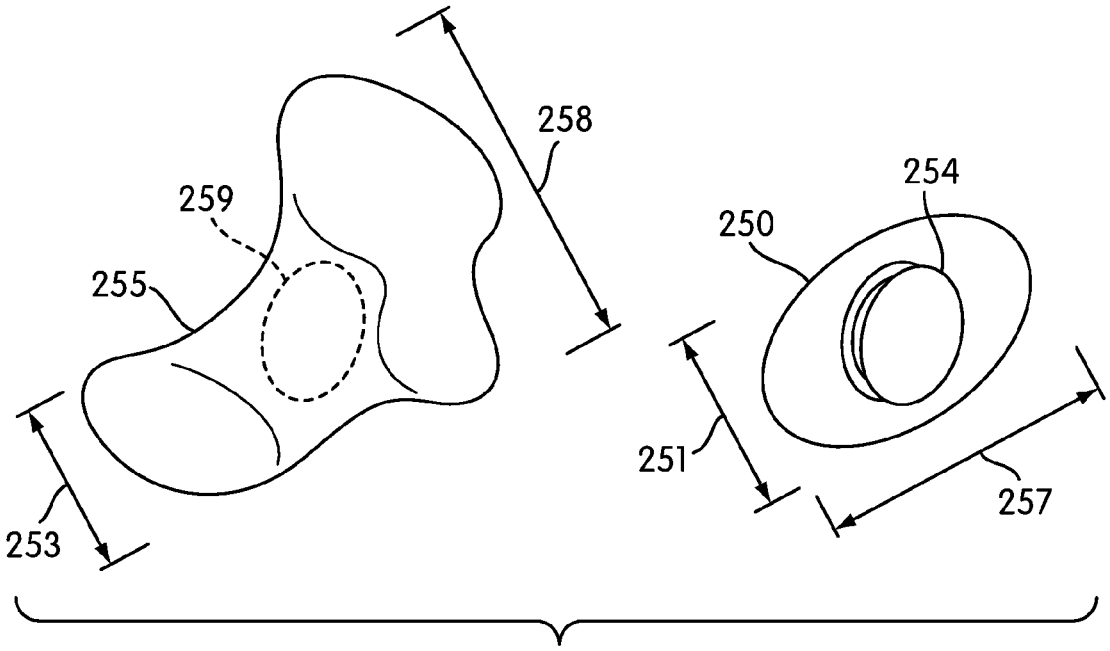
FIG. 11 is a perspective view of an embodiment of a large set of removable spacers.

Referring to FIG. 11, the large insert set includes a large medial insert 250 and a large lateral insert 255 for use when the user's foot is relatively small compared to the size of an article of footwear. Large medial insert 250 may have any shape, but in this embodiment has a semi-ovoid shape having a first width 251 and a first length 257. In other embodiments, large medial insert 250 may have other shapes, such as hemispherical, substantially hemispherical with protrusions or indentations, or any other shape known in the art. Preferably, large medial insert 250 is smooth to inhibit irritation to the foot. First width 251 and first length 257 may have any desired size. Large medial insert 250 also includes a medial attachment 254 configured to removably attach large medial insert 250 to the interior of an article of footwear. Medial attachment 254 is similar to the attachments discussed above. In this embodiment, medial attachment 254 is configured to be press-fitted into a corresponding recess formed in the heel region of the article of footwear.

Large lateral insert 255 is similar in size and shape to large lateral insert 155, discussed above. Large lateral insert 255 may have a non-uniform shape, having a first end height 253 that is different from a second end height 258. The first and second ends of large lateral insert 255 may also protrude medially. This shape is configured to rest against a relatively large portion of the heel of the user. The protruding portions of large lateral insert 255 may push the heel of the user medially for a more stable fit. Large lateral insert 255 also includes a lateral attachment 259 similar to medial attachment 254 to removably attach large lateral insert 255 to an article of footwear.

Those of skill in the art will recognize that attachments 254 and 259 are sized and shaped similarly. Thus, large medial insert 250 may be inserted into the receiving portion on the lateral side of the article of footwear. Similarly, large lateral insert 255 may be inserted into the receiving portion on the medial side of the article of footwear. A user may find that having the more substantial, complex geometry of an insert like later lateral insert 255 positioned on the medial side of the foot may be more stable and comfortable.

Figure 14:
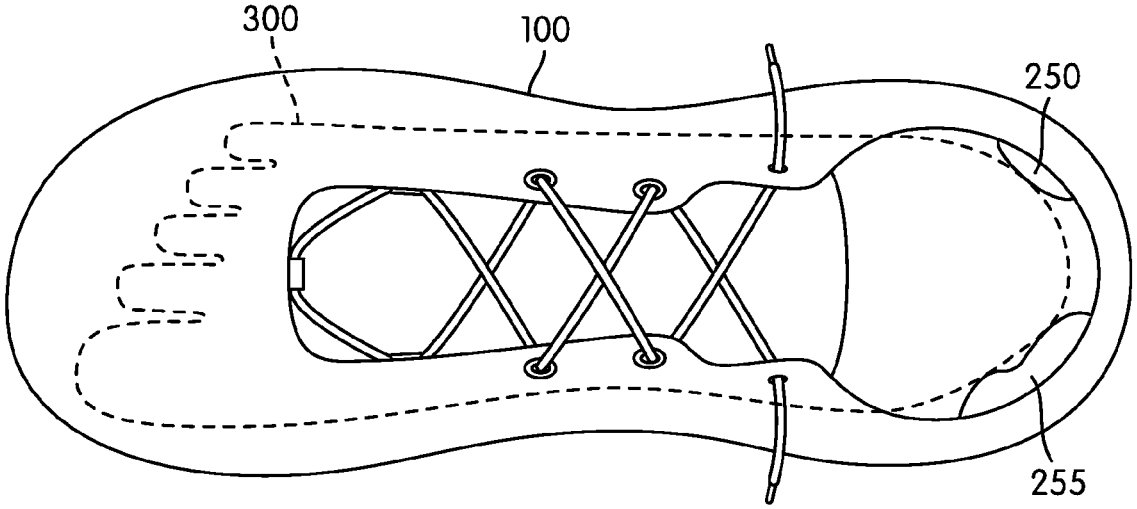
FIG. 14 is a top view of an embodiment of an article of footwear with a large size set of removable spacers.

FIG. 14 shows article of footwear 100 with large medial insert 250 and large lateral insert 255 inserted into a heel region. Large lateral insert 255 occupies a relatively large volume of the heel region of article of footwear 100, which allows a small foot 300 to fit comfortably within article of footwear 100.

Figure 12:
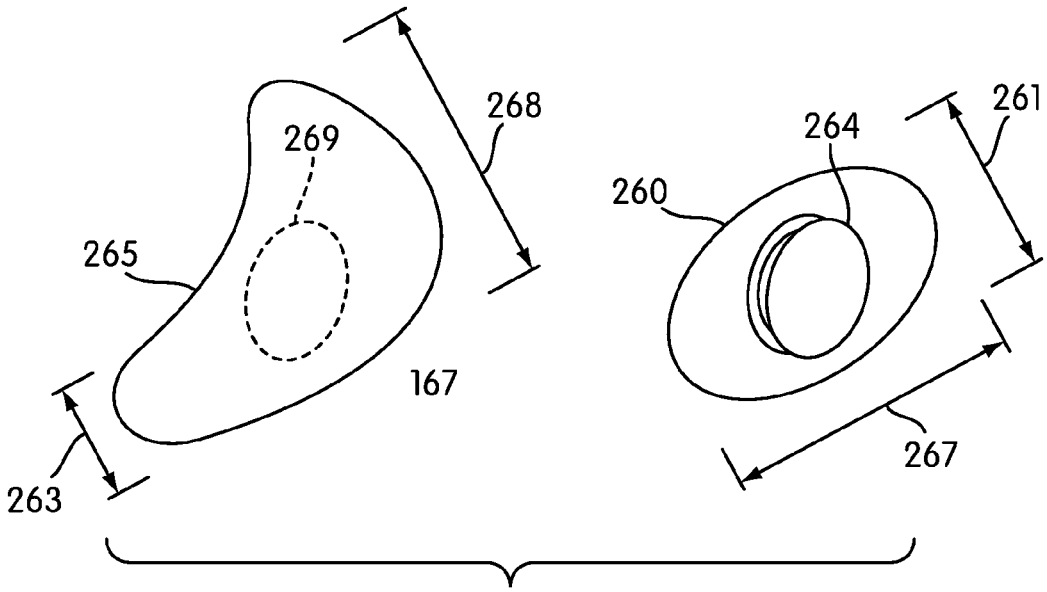
FIG. 12 is a perspective view of an embodiment of a medium set of removable spacers.

Referring to FIG. 12, the medium insert set includes a medium medial insert 260 and a medium lateral insert 265. Medium medial insert 260 may have any shape, but in this embodiment has a semi-ovoid shape having a second width 261 and a second length 267. In other embodiments, medium medial insert 260 may have other shapes, such as hemispherical, substantially hemispherical with protrusions or indentations, or any other shape known in the art. Similar to large medial insert 250, medium medial insert 260 may have a smooth surface to inhibit irritation to the foot. Second width 261 and second length 267 may have any desired size, but are preferably similarly sized or smaller than first width 251 and first length 257.

Medium medial insert 260 also includes a medial attachment 264 configured to removably attach medium medial insert 260 to the interior of an article of footwear. Medial attachment 264 is similar to the attachments discussed above. In this embodiment, medial attachment 264 is configured to be press-fitted into a corresponding recess formed in the heel region of the article of footwear.

Medium lateral insert 265 may be similar in size and shape to medium lateral insert 155, discussed above. Medium lateral insert 265 may have a non-uniform shape, having a first end height 263 that is different from a second end height 268. Unlike large lateral insert 255, medium lateral insert 265 may have a smooth surface, i.e., without protrusions. This shape is configured to rest against a smaller portion of the heel of the user than large lateral insert 255. Medium lateral insert 265 may be larger than medium medial insert 260 so that the heel of the user is pushed medially for a more stable fit. Medium lateral insert 265 also includes a lateral attachment 269 similar to medial attachment 264 to removably attach medium lateral insert 265 to an article of footwear.

Those of skill in the art will recognize that attachments 264 and 269 may be sized and shaped similarly. Thus, medium medial insert 260 may be inserted into the receiving portion on the lateral side of the article of footwear. Similarly, medium lateral insert 265 may be inserted into the receiving portion on the medial side of the article of footwear. In other words, inserts 260 and 265 may be interchangeable with each other in addition to being interchangeable with inserts 250 and 255. A user may find that having the more substantial, complex geometry of an insert like lateral insert 265 positioned on the medial side of the foot may be more stable and comfortable.

Figure 15:
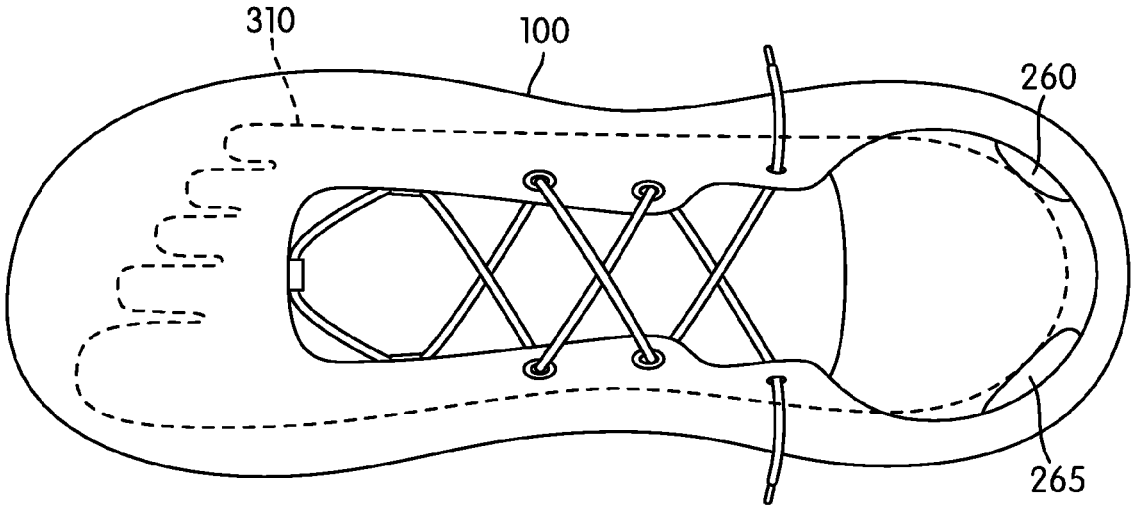
FIG. 15 is a top view of an embodiment of an article of footwear with a medium size set of removable spacers.

FIG. 15 shows article of footwear 100 with medium medial insert 260 and medium lateral insert 265 inserted into a heel region of article of footwear 100. Medium lateral insert 265 occupies less of the volume of the heel region of article of footwear 100 than does large lateral insert 255, and medium medial insert 260 occupies a similar or smaller volume than does large medial insert 250. This reduction in the volume occupied by the inserts allows a medium foot 310 to fit comfortably within article of footwear 100.

Figure 13:
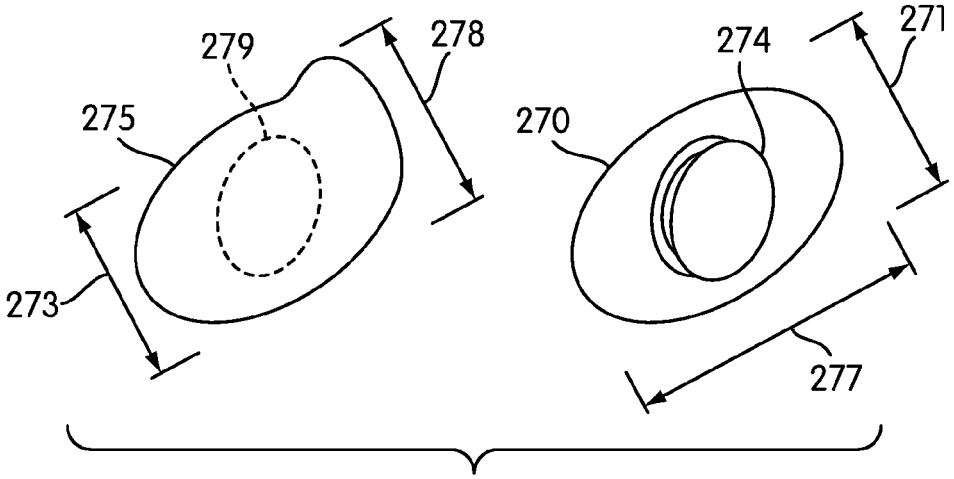
FIG. 13 is a perspective view of an embodiment of a small set of removable spacers.

Referring to FIG. 13, the small insert set includes a small medial insert 270 and a small lateral insert 275. Small medial insert 270 may have any shape, but in this embodiment has a semi-ovoid shape having a third width 271 and a third length 277. In other embodiments, small medial insert 270 may have other shapes, such as hemispherical, substantially hemispherical with protrusions or indentations, or any other shape known in the art. Similar to large medial insert 250, small medial insert 270 may have a smooth surface to inhibit irritation to the foot. Third width 271 may have any desired size but is preferably similarly sized or smaller than first width 251 and second width 267. Similarly, third length 277 may have any desired size but is preferably similarly sized or smaller than first length 257 and second length 267.

Small medial insert 270 also includes a medial attachment 274 configured to removably attach small medial insert 270 to the interior of an article of footwear. Medial attachment 274 is similar to the attachments discussed above. In this embodiment, medial attachment 274 is configured to be press-fitted into a corresponding recess formed in the heel region of the article of footwear.

Small lateral insert 275 may be similar in size and shape to small medial insert 270. Small lateral insert 275 may have a non-uniform shape, having a first end height 273 that is different from a second end height 278. Unlike large lateral insert 255, small lateral insert 275 may have a smooth surface. This shape is configured to rest against a smaller portion of the heel of the user than large lateral insert 255 or medium lateral insert 265. Small lateral insert 275 may be larger than small medial insert 270 so that the heel of the user is pushed medially for a more stable fit. In some embodiments, small lateral insert 275 may be similar or identical to small medial insert 270. Small lateral insert 275 also includes a lateral attachment 279 similar to medial attachment 274 to removably attach small lateral insert 275 to an article of footwear.

Similar to the attachments discussed above, attachments 274 and 279 may be sized and shaped to be interchangeable with each other. Thus, a user may select the more comfortable and/or stable configuration.

Figure 16:
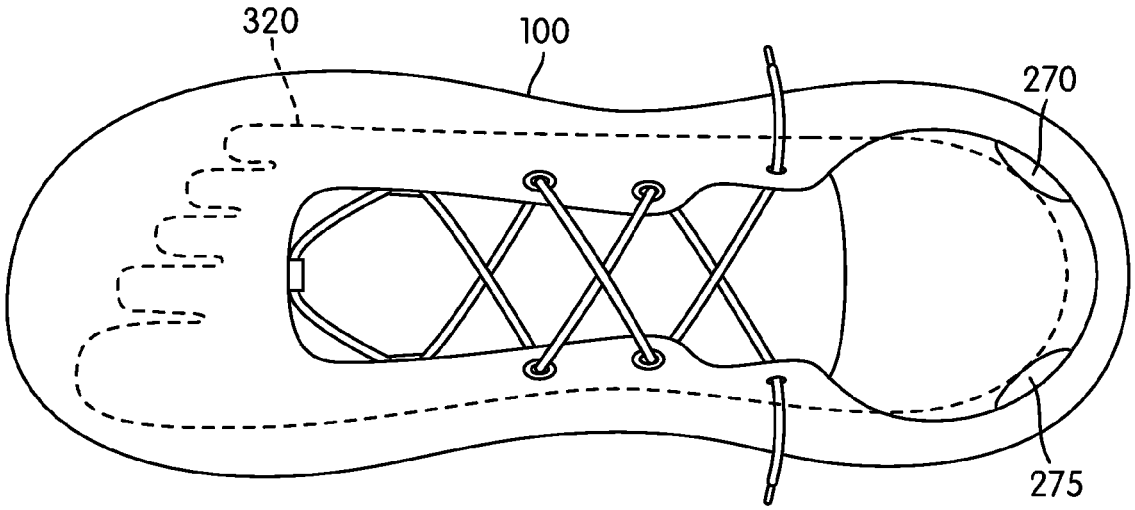
FIG. 16 is a top view of an embodiment of an article of footwear with a small size set of removable spacers.

FIG. 16 shows article of footwear 100 with small medial insert 270 and small lateral insert 275 inserted into a heel region of article of footwear 100. Small lateral insert 275 occupies less of the volume of the heel region of article of footwear 100 than does large lateral insert 255 or medium lateral insert 265. Similarly, small medial insert 270 may occupy a similar volume or a smaller volume of the heel region of article of footwear 100 than does either large medial insert 250 or medium medial insert 260. The reduction in the size of the small inserts 270 and 275 allow a small foot 320 to fit comfortably and stably within article of footwear 100.

While various embodiments of the invention have been described, the description is intended to be exemplary, rather than limiting and it will be apparent to those of ordinary skill in the art that many more embodiments and implementations are possible that are within the scope of the invention.

Accordingly, the invention is not to be restricted except in light of the attached claims and their equivalents. Also, various modifications and changes may be made within the scope of the attached claims.

I claim:

1. A system for modifying the size of an article of footwear comprising:

an article of footwear having an upper including a sidewall defining an interior void configured to receive a foot of a wearer, the upper having an inward-facing surface facing toward the interior void;

the article of footwear further including a first connector and a second connector disposed within the sidewall of the upper, wherein an inward-facing surface of the first connector, facing toward the interior void, is substantially flush with the inward-facing surface of the upper, and an inward-facing surface of the second connector, facing toward the interior void, is substantially flush with the inward-facing surface of the upper;

the first connector being formed of a different piece of material than the upper and the second connector being formed of a different piece of material than the upper, wherein the first connector defines a first recess in a heel region of the article of footwear, and the second connector defines a second recess in the heel region of the article of footwear;

a first set of removable inserts configured to be removably attached to the first connector;

a second set of removable inserts configured to be removably attached to the second connector;

wherein the first set of removable inserts includes a first removable insert and a second removable insert that is shaped differently than the first removable insert;

wherein the second set of removable inserts includes a third removable insert and a fourth removable insert;

wherein the first removable insert and the second removable insert are interchangeable, and the second removable insert and the fourth removable insert are interchangeable;

wherein the first removable insert includes a first attachment portion and the second removable insert includes a second attachment portion that is substantially similar to the first attachment portion, wherein the first recess is configured to interchangeably receive at least a portion of the first attachment portion and the second attachment portion;

wherein the second recess is configured to interchangeably receive at least a portion of each of the third removable insert and the fourth removable insert; and wherein the first removable insert and the second removable insert are interchangeable independent of the third removable insert and the fourth removable insert.

2. The system according to claim 1, wherein the first removable insert and the third removable insert, when inserted, configure the article of footwear to a first size and the second removable insert and the fourth removable insert, when inserted, configure the article of footwear to a second size that is different from the first size.

3. The system according to claim 2, further comprising a fifth removable insert configured to be removably attached to a heel region of the article of footwear interchangeably with the first removable insert and the second removable insert, and a sixth removable insert configured to be removably attached to a heel region of the article of footwear interchangeably with the third removable insert and the fourth removable insert;

wherein, the fifth removable insert and the sixth removable insert, when inserted, configure the article of footwear to a third size.

4. The system according to claim 3, wherein at least one of the fifth and sixth removable inserts is disposed within the heel region of the article of footwear.

5. The system according to claim 3, wherein the fifth removable insert comprises a medial removable insert configured to be disposed on a medial portion of the heel region and the sixth removable insert comprises a lateral removable insert configured to be disposed on a lateral portion of the heel region.

6. The system according to claim 3, wherein the first removable insert is larger than the second removable insert and the second removable insert is larger than the fifth removable insert.

7. The system according to claim 1, wherein the first connector includes a first interference lip configured to engage with the first attachment portion of the first removable insert and with the second attachment portion of the second removable insert.

8. The system according to claim 1, wherein the first removable insert comprises a first medial removable insert attachable to a medial portion of the heel region and the third removable insert comprises a first lateral removable insert attachable to a lateral portion of the heel region; and wherein the second removable insert comprises a second medial removable insert attachable to the medial portion of the heel region and the fourth removable insert comprises a second lateral removable insert attachable to the lateral portion of the heel region.

9. The system according to claim 8, wherein the first medial removable insert and the first lateral removable insert are substantially mirror-images of each other.

10. The system according to claim 8, wherein the first medial removable insert and the first lateral removable insert are not substantially mirror-images of each other.

11. The system according to claim 8, wherein the first medial removable insert and the first lateral removable insert are each substantially oval shaped.

12. The system according to claim 8, wherein the first medial removable insert or the first lateral removable insert is non-uniformly shaped.

13. The system according to claim 8, wherein the first medial removable insert and the first lateral removable insert are each substantially hemispherical shaped.

14. The system according to claim 8, wherein the first lateral removable insert is larger than the first medial removable insert.

15. The system according to claim 1, wherein the first attachment portion of the first removable insert is configured to match with a shape of the first recess of the first connector and the second attachment portion of the second removable insert is configured to match with a shape of the second recess of the second connector.

16. The system according to claim 1, wherein at least a portion of each of the first and second removable inserts may be press-fitted into the first recess.

17. The system according to claim 1, wherein at least one of the first removable insert and the second removable insert has a smooth surface without protrusions.

18. The system according to claim 1, wherein at least one of the first and second removable inserts is an anatomically shaped insert that is shaped to conform to the anatomical shape of the calcaneus bone.

19. The system according to claim 18, wherein an anterior surface contacting region of the anatomically shaped insert has a smaller height than a posterior surface contacting region of the anatomically shaped insert.

20. A system for modifying the size of an article of footwear comprising:

an article of footwear including an upper including a sidewall defining an interior void configured to receive a foot of a wearer, the upper having an inward-facing surface facing toward the interior void;

the article of footwear further including a first connector and a second connector disposed within the upper;

a first removable insert configured to be removably attached to the first connector, and a second removable insert configured to be removably attached to the second connector independently of the attachment of the first removable insert to the first connector;

wherein the first removable insert includes a first attachment portion and the second removable insert includes a second attachment portion;

wherein the first attachment portion of the first removable insert and the second attachment portion of the second removable insert are configured to be interchangeably connected to the first connector and the second connector within the upper of the article of footwear;

wherein the first connector includes a first cavity having a pre-defined size and shape that corresponds with a size and shape of the first attachment portion of the first removable insert and corresponds with a size and shape of the second attachment portion of the second removable insert; and wherein an inward-facing surface of the first connector, facing toward the interior void, is substantially flush with the inward-facing surface of the upper, and an inward-facing surface of the second connector, facing toward the interior void, is substantially flush with the inward-facing surface of the upper.

21. The system according to claim 20, wherein the first cavity of the first connector has a substantially circular shape.

22. The system according to claim 21, wherein the first and second removable inserts are configured to be removably attached to a heel region of the article of footwear; and wherein at least one of the first and second removable inserts includes a removable anatomically shaped insert that is shaped to conform to the anatomical shape of the calcaneus bone.

23. The system according to claim 22, wherein an anterior surface contacting region of the anatomically shaped insert has a smaller height than a posterior surface contacting region of the anatomically shaped insert.

24. The system according to claim 20, wherein the first connector includes a first interference lip configured to engage with the first attachment portion of the first removable insert.

* * * * *